US006258747B1

(12) United States Patent
Midorikawa et al.

(10) Patent No.: US 6,258,747 B1
(45) Date of Patent: Jul. 10, 2001

(54) THERMALLY SENSITIVE RECORDING MEDIUM

(75) Inventors: Yoshimi Midorikawa; Kaoru Hamada; Yoshihide Kimura, all of Shinjuku-ku; Tomoaki Nagai, Kita-ku, all of (JP)

(73) Assignee: Nippon Paper Industries Co Ltd, Tokyo (JP)

( * ) Notice: Subject to any disclaimer, the term of this patent is extended or adjusted under 35 U.S.C. 154(b) by 0 days.

(21) Appl. No.: 09/334,271

(22) Filed: Jun. 16, 1999

(30) Foreign Application Priority Data

Jun. 22, 1998 (JP) ..... 10-174295
Aug. 31, 1998 (JP) ..... 10-244568

(51) Int. Cl.[7] ..... B41M 5/20

(52) U.S. Cl. ..... 503/217; 106/31.19; 106/31.21; 503/220

(58) Field of Search ..... 427/150, 151; 503/204, 220, 216, 217; 106/31.19, 31.21

(56) References Cited

U.S. PATENT DOCUMENTS

Re. 30,797 11/1981 Davis ..... 427/288
4,939,117 7/1990 Kusakata et al. ..... 503/224

FOREIGN PATENT DOCUMENTS 0356386 2/1990 (EP) .
0561738 9/1993 (EP) .

OTHER PUBLICATIONS

Database WPI, Section Ch, Week 199347, Derwent Publications Ltd., London, GB; Class G05, An 1993–374220 & JP 05 278328 A –Abstract.

Patent Abstracts of Japan, vol. 199, No. 507, Aug. 31 1995 & JP 07 108764 –Abstract.

Patent Abstracts of Japan, vol. 017, No. 576,. Oct. 20 1993 & JP 05 169828 A –Abstract.

Patent Abstracts of Japan, vol. 017, No. 576, Oct. 20 1993 & JP 05 169827 A –Abstract.

Japanese Laid–open Publication 05–278328 (English abstract).

Japanese Laid–open Publication 10–315636 (English abstract).

Japanese Laid–open Publication 09–221832 (English abstract).

*Primary Examiner*—Bruce H. Hess

(57) ABSTRACT

A thermally sensitive recording medium having sufficient color developing density and which develops russet or wine red color. The recording medium incorporates a dye precursor which includes at least one red color developing leuco dye having a maximum absorption wavelength of 480 to 570 nm and at least one black color developing leuco dye with maximum absorption wavelengths at 420 to 480 nm and 550 to 640 nm. The color difference a* value of developed image of said thermally sensitive recording medium, measured according to JIS-Z-8729 is within the region of 0 to 50 and b* value is within the region of −15 to 10.

4 Claims, No Drawings

THERMALLY SENSITIVE RECORDING MEDIUM

BACK GROUND OF THE INVENTION

The present invention relates to a thermally sensitive recording medium which develops russet or wine red color.

DESCRIPTION OF THE PRIOR ART

Generally, the thermally sensitive recording medium possessing a thermally sensitive recording layer mainly comprising a colorless or a pale colored electron donating dye precursor (hereinafter shortened to dye precursor) and a color developer which develops color when heated together with said dye precursor was disclosed in Japanese Patent publication 45-14035 and had been widely utilized practically. As a recording apparatus for this thermal sensitive recording medium, a thermally printer to which a thermal head is installed can be used. The recording method mentioned above has strong points in comparison with other conventional recording methods, namely, noiseless during recording, a developing and a printing procedure are not needed, maintenance free, apparatus is relatively low price and compact and a recorded pattern is very vivid. Therefore, along with the growth of information industry, the application of this method is widely expanded, for instance, applications for a facsimile or a computer, for many kinds of measuring equipment and for a label. The developed color image of these thermally sensitive recording medium is mainly black color, however, a red color developing type, a blue color developing type, a green color developing type, a full color developing type and a dual color developing type are also well known.

The developed color of thermally sensitive recording medium is comparatively sharp and close to a photograph, and recently has been used as an output means of image which is taken by a camera attached to a game machine. Accompanied with the extension of uses, a thermally sensitive recording medium which develops neutral color such as russet color or wine red color is becoming to be desired. However, in the conventional field of thermally sensitive recording medium, there is still a need for a thermally sensitive recording medium which develops these neutral color.

The object of this invention is to provide a thermally sensitive recording medium which has a sufficient color density and develops russet or wine red color.

To accomplish the above mentioned object, the present invention provides a thermally sensitive recording medium having a thermally sensitive color developing layer containing a colorless or a pale colored dye precursor and a color developer as a main component on a substrate, wherein the color difference a* value regulated by JIS-Z-8729 of developed image of said thermally sensitive recording medium is 0~50, and the color difference b* value regulated by JTS-Z-829 of developed image of said thermally sensitive recording medium is −15~10.

The color difference a* value is a parameter which indicates green color, and when the minus value of a* is big, the greenish tone is strong. And when the value approaches to 0, the greenish tone becomes weak. Further, plus a* value indicates the reddish tone. Meanwhile, the color difference b* value is a parameter which indicates blue tone and when the minus value of b* is big, the bluish tone is strong. When the value approaches to 0, the bluish tone becomes weak, and plus b* value indicates yellowish tone. In the thermally sensitive recording medium of this invention, the color difference a* value of developed image is 0~50 and b* value is −15~0, and the required russet or wine red color tone can be obtained. Further, more vivid tone can be obtained when color difference a* value is 10~50 and b* value is −15~0, more desirably a* value is 15~45 and b* value is −10~0. When these color difference values are out of the region regulated in this invention, the color of developed image becomes red or black and the object color tone can not be obtained.

In addition to a* and b* value regulating in this invention, the color tone can be also indicated by L* value which displays brightness. L* value is not limited in this invention, however, when L* value is too low, color tone becomes dark. Therefore, desirably the practical L* value is to be 20~60, and more desirably to be 20~50.

In a preferred embodiment, the present invention provides the thermally sensitive recording medium as described above, wherein dye precursor is comprises at least one kind of an orange color developing leuco dye whose maximum absorption wave length is 480~570 nm and at least one kind of a black color developing leuco dye whose maximum absorption wave length is 420~480 nm and 550~640 nm. The maximum absorption wave length of this invention is measured in 99% acetic acid solution. Thus, by the combination use of leuco dyes whose maximum absorption wave lengths are different, the thermally sensitive recording medium which develops neutral color such as russet color or wine red color can be easily obtained.

In another embodiment, the invention provides the thermally sensitive recording medium containing 0.05~1 parts of black color developing leuco dye whose maximum absorption wave length is 420~480 nm and 550~640 nm to 1 part of red color developing leuco dye whose maximum absorption wave length is 480~570 nm. When the content of black color developing leuco dye is smaller than 0.05 parts to 1 part of red color developing leuco dye, the aimed color tone can be obtained, however, the color density becomes slightly low. This is not a problem in a practical use, but the contrast of developed image is slightly bad. Conversely, when the content is bigger than 1 part, the contrast of developed image is good, but the black color tone becomes slightly strong. Therefore, it is desirable that the black color developing leuco dye is contained in the above mentioned ratio to the red color developing leuco dye to obtain the thermally sensitive recording medium whose developed image is vivid russet or wine red color and the contrast of image is good.

Preferebly, the thermally sensitive recording medium contains at least one kind of chemical compound indicated by general formula (1) as red color developing leuco dye whose maximum absorption wave length is 480~570 nm.

(1)

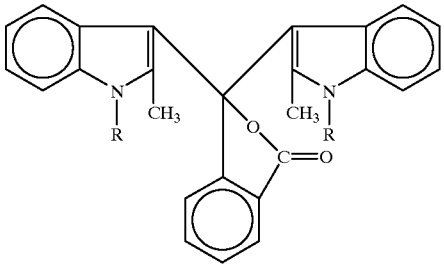

The use of these leuco dyes is effective to obtain the russet or wine red color which is the object of this invention.

Further, the preserving ability of the developed image is improved, and especially the resistance to the plasticizer is remarkably improved. The reason for above mentioned improvement can not be clearly explained, however, in this invention, it is assumable that the polarity of the compound represented by general formula (1) is high, and the solubility of developed image formed by the reaction with a color developer to the plasticizer becomes low.

It is also preferred that the thermally sensitive recording medium which displays the developed color image of russet or wine red color. In this invention, the term "russet " or "wine red " color means dim and dark neutral tone developing of red, which is disclosed e.g. from page 32 to 33, in item "8 Dull & Dark red" of "Color one point 10, color naming and it's episode" (Japan Standard Society, issued on Nov. 19, 1993). These colors are expressed as dim red or dark red by JIS common name, or are expressed as russet, reddish brown or garnet color by idiomatic color naming. Further, the expression of color becomes different by a subjectivity of inspector or by an illumination, and in this invention, the expression of russet color or wine red color are typically used containing commonly expressed wine red color, rose color or reddish purple color, however, not limited to them.

As a leuco dye which develops red color used in this invention, the leuco dye whose maximum absorption wave length in 99% acetic acid solution is from 480~570 nm can be used. As the concrete examples, 3-diethylamino-6-methyl-7-chlorofluoran,
3-diethylamino-benzo[a]fluoran,
3-diethylamino-7-chlorofluoran,
3-diethylamino-7-methylfluoran,
3-N-ethyl-N-isoamylamino-benzo[a]fluoran,
3-N-ethyl-N-p-methylphenylamino-7-methylfluoran,
3-dibutylamino-6-methyl-7-bromofluoran,
3,6-bis(diethylamino)fluoran-γ-(4'-nitro)-anilinolactam,
3,3-bis(1-n-butyl-2-methylindol-3-yl)phthalido,
3,3-bis(1-n-octyl-2-methylindol-3-yl)phthalido,
3,3-bis(1-ethyl-2-methylindol-3-yl)phthalido and
3,6-bis(diethylamino)fluoran-γ-anilinolactam, can be mentioned, however, not limited to them. And these leuco dyes can be used alone or can be used together. Among above mentioned chemicals,
3,3-bis(1-n-butyl-2-methylindol-3-yl)phthalido,
3,3-bis(1-n-octyl-2-methylindol-3-yl)phthalido and
3,3-bis(1-ethyl-2-methylindol-3-yl)phthalido are the compounds indicated by above mentioned formula (1).

As a leuco dye which develops black color which is used in this invention, the leuco dye whose maximum absorption wave length in 99% acetic acid solution is 420~480 nm and 550~640 nm can be used. As the concrete example, 3-diethylamino-6-methyl-7-anilinofluoran,
3-diethylamino-6-methyl-7-(o,p-dimethylanilino)fluoran,
3-diethylamino-6-methyl-7-(p-chloroanilino)fluoran,
3-diethylamino-6-methyl-7-m-methylanilinofluoran,
3-diethylamino-6-methyl-7-n-octhylaminofluoran,
3-diethylamino-6-chloro-7-anilinofluoran,
3-diethylamino-7-(m-trifluoromethylanilino)fluoran,
3-diethyl amino-7-(o-chloroanilino)fluoran,
3-diethylamino-7-(o-fluoroanilino)fluoran,
3-diethylamino-6-methyl-7-(p-n-butylanilino)fluoran,
3-dibutylamino-6-methyl-7-anilinofluoran,
3-dibutylamino-6-methyl-7-(o,p-dimethylanilino)fluoran,
3-dibutylamino-7-(o-chloroanilino)fluoran,
3-dibutylamino-7-(o-fluoroanilino)fluoran,
3-di-n-pentylamino-6-methyl-7-anilinofluoran,
3-di-n-pentylamino-7-(m-trifuluoromethylanilino)fluoran,
3-pyrrolidino-6-methyl-7-anilinofluoran,
3-piperidino-6-methyl-7-anilinofluoran,
3-(N-methyl-N-propylamino)-6-methyl-7-anilinofluoran,
3-(N-methyl-N-cyclohexylamino)-6-methyl-7-anilinofluoran,
3-(N-ethyl-p-toluidino)-6-methyl-7-anilinofluoran,
3-(N-ethyl-N-isoamylamino)-6-methyl-7-anilinofluoran,
3-(N-ethyl-N-tetrahydrofrufurylamino)-6-methyl-7-anilinofluoran,
3-(N-ethyl-N-isobutylamino)-6-methyl-7-anilinofluoran,
3-(N-ethyl-N-ethoxypropylamino)-6-methyl-7-anilinofluoran and
2,4-dimethyl-6-[(4-dimethylamino)anilino]-fluoran can be mentioned, however, not limited to them. And these leuco dyes can be used alone or can be used together.

In this invention, it is possible to add a small amount of leuco dye which develops orange color to obtain a desire color tone. The desirable amount to be added is less than 0.05 parts of orange color developing leuco dye to 1 part of red color developing leuco dye. As the concrete examples of a leuco dye which develops orange color, 3-cyclohexylamino-6-chlorofluoran and 3-diethylamino-6,8-dimethylfluoran can be mentioned, however, not limited to them.

As an organic color developer which can be used in this invention, bis-phenol A type,
4-hydroxyphthalic acid ester type,
4-hydroxyphthalic acid diester type,
phthalic acid monoester type,
bis-(hydroxyphenyl)sulfide type,
4-hydroxyphenylarylsulfone type,
4-hydroxyphenylarylsulfonate type,
1,3-di[2-(hydroxyphenyl)-2-propyl]benzene type,
4-hydroxybenzoyloxybenzoic acid ester type and bisphenolsulfone type which are disclosed in Japanese Patent Laid-Open Publication 3-207688 or Japanese Patent Laid-Open Publication 5-24366 can be mentioned. The typical concrete well known examples are shown below, however, not intended to be limited to them. These developers can be used alone or used together.

<bisphenol A type>
4,4'-isopropylidenediphenol (another name is bisphenol A),
4,4'-cyclohexylidenediphenol,
p,p'-(1-methyl-n-hexylidene)diphenol,
1,7-di(hydroxyphenylthio)-3,5-dioxaheptane.

<4-hydroxybenzoic ester type>
4-hydroxybenzyl benzoate,
4-hydroxyethyl benzoate,
4-hydroxypropyl benzoate,
4-hydroxyisopropyl benzoate,
4-hydroxybutyl benzoate,
4-hydroxyisobutyl benzoate,
4-hydroxymethylbenzyl benzoate.

<4-hydroxyphthalic acid diester type>
4-hydroxydimethyl phthalate,
4-hydroxydiisopropyl phthalate,
4-hydroxydibenzyl phthalate,
4-hydroxydihexyl phthalate.

<phthalic acid monoester type>
monobenzyl phthalate,
monocyclohexyl phthalate,
monophenyl phthalate,
monomethylphenyl phthalate,
monoethylphenyl phthalate,
monopropylbenzy phthalate,
monohalogenbenzyl phthalate,
monoethoxybenzyl phthalate.

<bis-(hydroxyphenyl)sulfide type>
bis-(4-hydroxy-3-tert-butyl-6-methylphenyl)sulfide,
bis-(4-hydroxy-2,5-dimethylphenyl)sulfide,
bis-(4-hydroxy-2-methyl-5-ethylphenyl)sulfide,
bis-(4-hydroxy-2-methyl-5-isopropylphenyl)sulfide,
bis-(4-hydroxy-2,3-dimethylphenyl)sulfide,
bis-(4-hydroxy-2,5-dimethylphenyl)sulfide,
bis-(4-hydroxy-2,5-diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)sulfide,
bis-(2,3,4-trihydroxyphenyl)sulfide,
bis-(4,5-dihydroxy-2-tert-butylphenyl)sulfide,
bis-(4-hydroxy-2,5-diphenylphenyl)sulfide,
bis-(4-hydroxy-2-tert-octyl-5-methylphenyl)sulfide.
<4-hydroxyphenylarylsulfone type>
4-hydroxy-4'-isopropoxydiphenylsulfone,
4-hydroxy-4'-n-buthoxydiphenylsulfone,
4-hydroxy-4'-n-propoxydiphenylsulfone,
<4-hydroxyphenylarylsulfonate type>
4-hydroxyphenylbenzenesulfonate,
4-hydroxyphenyl-p-tolylsulfonate,
4-hydroxyphenylmethylenesulfonate,
4-hydroxyphenyl-p-chlorobenzenesulfonate,
4-hydroxyphenyl-p-tert-butylbenzenesulfonate,
4-hydroxyphenyl-p-isopropoxybenzenesulfonate,
4-hydroxyphenyl-1'-naphthalenesulfonate,
4-hydroxyphenyl-2'-naphthalenesulfonate.
<1,3-di[2-(hydroxyphenyl)-2-propyl]benzene type>
1,3-di[2-(4-hydroxyphenyl)-2-propyl]benzene,
1,3-di[2-(4-hydroxy-3-alkylphenyl)-2-propyl]benzene,
1,3-di[2-(2,4-dihydroxyphenyl)-2-propyl]benzene,
3-di[2-(2-hydroxy-5-methylphenyl)-2-propyl]benzene.
<resorcinol type>
1,3-dihydroxy-6(α,α-dimethylbenzyl)-benzene.
<4-hydroxybenzoyloxybenzoic acid ester type>
4-hydroxybenzoyloxybenzyl benzoate,
4-hydroxybenzoyloxymethyl benzoate,
4-hydroxybenzoyloxyethyl benzoate,
4-hydroxybenzoyloxypropyl benzoate,
4-hydroxybenzoyloxybutyl benzoate,
4-hydroxybenzoyloxypropyl benzoate,
4-hydroxybenzoyloxytert-butyl benzoate,
4-hydroxybenzoyloxyhexyl benzoate,
4-hydroxybenzoyloxyoctyl benzoate,
4-hydroxybenzoyloxynonyl benzoate,
4-hydroxybenzoyloxycyclohexyl benzoate,
4-hydroxybenzoyloxy β-phenethyl benzoate,
4-hydroxybenzoyloxyphenyl benzoate,
4-hydroxybenzoyloxy α-naphthyl benzoate,
4-hydroxybenzoyloxy β-naphthyl benzoate,
4-hydroxybenzoyloxy sec-butyl benzoate.
<bisphenolsulfone type (I)>
bis-(3-1-butyl-4-hydroxy-6-methylphenyl)sulfone,
bis-(3-ethyl-4-hydroxyphenyl)sulfone,
bis-(3-propyl -4-hydroxyphenyl)sulfone,
bis-(3-methyl-4-hydroxyphenyl)sulfone,
bis-(2-isopropyl-4-hydroxyphenyl)sulfone,
bis-(2-ethyl-4-hydroxyphenyl)sulfone,
bis-(3-chloro-4-hydroxyphenyl)sulfone,
bis-(2,3-dimethyl-4-hydroxyphenyl)sulfone,
bis-(2,5-dimethyl-4-hydroxyphenyl)sulfone,
bis-(3-methoxy-4-hydroxyphenyl)sulfone,
4-hydroxyphenyl-2'-ethyl-4'-hydroxyphenylsulfone,
4-hydroxyphenyl-2'-isopropyl-4'-hydroxyphenylsulfone,
4-hydroxyphenyl-3'-isopropyl-4'-hydroxyphenylsulfone,
4-hydroxyphenyl-3'-sec-butyl-4'-hydroxyphenylsulfone,
3-chloro-4-hydroxyphenyl-3'-isopropyl-4'-hydroxyphenylsulfone,
2-hydroxy-5-t-butylphenyl-4'-hydroxyphenylsulfone,
2-hydroxy-5-t-aminophenyl-4'-hydroxyphenylsulfone,
2-hydroxy-5-t-isopropylphenyl-4'-hydroxyphenylsulfone,
2-hydroxy-5-t-octylphenyl-4'-hydroxyphenylsulfone,
2-hydroxy-5-t-butylphenyl-3'-chloro-4'-hydroxyphenylsulfone,
2-hydroxy-5-t-butylphenyl-3'-methyl-4'-hydroxyphenylsulfone,
2-hydroxy-5-t-butylphenyl-3'-isopropyl-4'-hydroxyphenylsulfone,
2-hydroxy-5-t-butylphenyl-2'-methyl-4'-hydroxyphenylsulfone.
<bisphenolsulfone type (II)>
4,4'-sulfonyldiphenol,
2,4'-sulfonyldiphenol,
3,3'-dichloro-4,4'-sulfonyldiphenol,
3,3'-dibromo-4,4'-sulfonyldiphenol,
3,3',5,5'-tetrabromo-4,4'-sulfonyldiphenol,
3,3'-diamino-4,4'-sulfonyldiphenol.
<others>
p-tert-butylphenol,
2,4-dihydroxybenzophenone,
novolac type phenolic resin,
4-hydroxyacetophenone,
p-phenylphenol,
benzyl-4-hydroxyphenylacetate,
p-benzylphenol.

In the present invention, since the use of a color developer which has plural phenolic hydroxyl groups causes a problem of ground color contamination (ground color developing) by aqueous coating or by humidity in atmosphere, monophenol type color developer is preferably used when more higher ground color stability is required. Especially, monophenol sulfone type color developer represented by above mentioned 4-hydroxyphenylarylsulfone contains sulfonyl group in the molecule. A strong electron acceptor portion is formed by an electron attractive of this sulfonyl group, indicates strong reactivity with dye precursor and performs an excellent color developing ability, further the obtained thermally recording medium is also superior to the stability of ground color.

In this invention, a conventional well known sensitizer can be used, as long as the desired effect of this invention is not prevented. As an example of the sensitizer,
stearic acid amide,
palmitic acid amide,
methoxycarbonyl-N-benzamidestearate,
N-benzoylstearic acid amide,
N-eicosenoic acid amide,
ethylene-bis-stearic acid amide,
behenic acid amide,
methylene-bis-stearic acid amide,
methylolamide,
N-methylolstearic acid amide,
dibenzyl terephthalate,
dimethyl terephthalate,
dioctyl terephthalate,
p-benzyloxybenzylbenzoate,
1-hydroxy-2-phenylnaphthoate,
dibenzyloxalate
di-p-methylbenzyloxalate,
di-p-chlorobenzyloxalate,
2-naphthylbenzylether,
m-tarphenyl,
p-benzylbiphenyl, 4-biphenyl-p-tolylether
di(p-methoxyphenoxyethyl)ether
2-di(3-methylphenoxy)ethane
1,2-di(4-methylphenoxy)ethane
1,2-di(4-methoxyphenoxy)ethane
1,2-di(4-chlorophenoxy)ethane
1,2-diphenoxyethane
1-(4-methoxyphenoxy)-2-(2-methylphenoxy)ethane
p-methylthiophenylbenzylether
1,4-di(phenylthio)buthane
p-acetotoluidide
p-acetophenetidide,
N-acetoacetyl-p-toluidine,
di-(β-biphenylethoxy)benzene,
p-di(vinyloxyethoxy)benzene,
1-isopropylphenyl-2-phenylethane
1,2-bis(phenoxymethyl)benzene
p-toluenesulfonamide,
o-toluenesulfonamide,
di-p-tolylcarbonate and
phenyl-α-naphtylcarbonate can be mentioned, however is not intended to be limited to these compounds. These sensitizers can be used alone or by mixing more than two kinds of them.

As the binder used in the present invention, full saponified polyvinyl alcohol of 200~1900 polymerization degree, partial saponified polyvinyl alcohol, polyvinyl alcohol by denatured carboxyl, polyvinyl alcohol by denatured amide polyvinyl alcohol by denatured sulfonic acid and polyvinyl alcohol by denatured butylal, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetate, polyacrylamide, polyacrylic acid ester, polyvinylbutyral, polystyrene or copolymer of them,polyamide resin, silicon resin, petroleum resin, terpene resin, ketone resin and cumarone resin can be illustrated. These macro molecule compounds can be applied by being dissolved into solvents such as water, alcohol, ketone, ester or hydrocarbon or by being dispersed in water or other medium under an emulsion state or a paste state and these forms of application can be used in combination according to the quality requirement.

In the present invention, it is also possible to add known stabilizers based on metal salts (Ca, Zn) of p-nitrobenzoic acid or metal salts (Ca, Zn) of monobenzylphthalate, which have an effect to endow the recorded image with oil resistance, so long the desired effect on the object of the present invention is not hindered.

As a filler which can be used in this invention, an inorganic or an organic filler such as silica, calcium carbonate, kaoline, calcined kaoline, diatomaceous earth, talc, titanium oxide, zinc oxide, aluminum hydroxide, polystyrene resin, urea-formaldehyde resin, copolymer of styrene-methacrylic acid, copolymer of styrene-butadiene and hollow plastic pigment can be mentioned.

Further, a parting agent such as metallic salt of fatty acid, a slipping agent such as wax, benzophenon-or triazole-based ultra violet absorbers, water proof agent such as glyoxal, dispersing agent, deformers, anti-oxidation agent and fluorescent dye can be used as an additive.

As a substrate, paper, synthetic paper, plastic film, plastic foam film, non-woven fabric, recycled paper, metallic foil and a complex of these materials can be used.

Further, for the purpose to improve friction resistance and image preserving ability, an overcoat layer comprising high polymer composition can be prepared on the surface of thermally sensitive color developing layer. Furthermore, for the purpose to improve the color sensitivity, an undercoat layer containing organic or inorganic filler can be prepared between color developing layer and substrate.

The amount of color developer and dye precursor, the kind and amount of other additives to be used to the thermally sensitive recording medium of this invention are decided according to the required quality and recording feature, and not limited. However, in general, it is preferable to use 0.4~4 parts of filler to 1 part of color developer and 5~25% of binder to the total amount of solid. When the red color developing leuco dye whose maximum absorption wave length is 480~570 nm and the black color developing leuco dye whose maximum absorption wave length is 420~480 nm and 550~640 nm as a dye precursor are used, the mixing ratio is decided by the required color tone, however, it is desirable to contain 0.05~1 parts of black color developing leuco dye to 1 part of red color developing leuco dyes and the desirable total parts of these leuco dye is 0.1~2 parts to 1 part of organic color developer. The color tone of developed image slightly changes by a stabilizer, a sensitizer and other additives, however the influence of it is not so remarkable.

These color developer, dye and other additives which are added at need are ground to the fine particles smaller than several microns diameter by means of a pulverizer such as a ball mill, an attriter or a sand grinder, or by means of an adequate emulsifying apparatus, then binder and other additives are added at need, thus the coating is prepared. As a method to coat the coating, a hand coating, a size press coating method, a roll coating method, an air knife coating method, a blend coating method, a flow coating method, a comma direct method, a gravure direct method, a gravure reverse method and a reverse-roll coating method can be mentioned. Further, the method to dry up after sputtering, spraying or dipping can also be used.

EXAMPLES AND COMPARATIVE EXAMPLES

<Preparation of Thermally Sensitive Recording Medium>

The spontaneously color changing type thermally sensitive recording medium of this invention is illustrated by following Examples. In Examples, terms of parts and % indicate parts by weight and weight %.

Example 1

Example 1 is an example of the thermally sensitive recording medium of this invention in which 4,4'-isopropyridenediphenol (bisphenol A, shortened to a in Table) is used as a color developer, 3,3-bis(1-n-butyl-2-methylindol-3-yl)phthalide, (shortened to R-1 in Table) is used as red color developing leuco dye whose maximum absorption wave length is 480~570 nm and 3-dibutyl-6-methyl-7-anilinofluoran (shortened to B-1 in Table) is used as a black color developing dye whose maximum absorption wave length is 420~480 nm and 550~640 nm.

Dispersion of color developer (A solution), dispersion of a red color developing leuco dye (B solution) and a black color developing leuco dye (C solution) prepared by following blending proportion are separately ground in a wet condition to average diameter of 1 μm by means of a sand grinder.

| | |
|---|---|
| A solution (dispersion of color developer) | |
| 4,4'-isopropylidenediphenol (a) | 6.0 parts |
| 10% aqueous solution of polyvinylalcohol | 18.8 parts |
| water | 11.2 parts |
| B solution (dispersions of red color developing leuco dye) | |
| 3,3-bis(1-n-butyl-2-methylindol-3-yl)phthalide (R-1) | 1.0 parts |
| 10% aqueous solution of polyvinylalcohol | 2.3 parts |
| water | 1.3 parts |
| C solution (dispersion of black color developing leuco dye) | |
| 3-dibutylamino-6-methyl-7-anilinofluoran (B-1) | 1.0 parts |
| 10% aqueous solution of polyvinylalcohol | 2.3 parts |
| water | 1.3 parts |

Then the resulting dispersion are mixed together by the proportion below and the coating is prepared.

| | |
|---|---|
| A solution (dispersion of color developer [a]) | 36.0 parts |
| B solution (dispersion of red color developing leuco dye [R-1]) | 10.58 parts |
| C solution (dispersion of black color developing leuco dye [B-1]) | 3.22 parts |
| Kaoline clay (50% dispersion) | 12.0 parts |

The prepared coating is applied to one side of 50 g/m$^2$ substrate paper and dried up, then the sheet is processed by a super calendar to surface smoothness of 500~600 second and the thermally sensitive recording medium of 6.0 g/m$^2$ coating amount can be obtained.

Examples 2~6

The thermally sensitive recording media are prepared by the same procedure to Example 1. At the preparation of A solution, 4-hydroxy-4'-isopropoxydiphenylsulfone (shortened to b; Example 2), 4-hydroxy-4'-propoxydiphenylsulfone (shortened to c; Example 3), 4-hydroxy-4'-butoxydiphenylsulfone (shortened to d; Example 4) and 4-hydroxybenzoic acid benzyl ester (shortened to e; Example 5)

4,4'-dihydroxydiphenylsulfone (shortened to f; Example 6) are used instead of 4,4'-isopropylidendiphenol (a)

Example 7

The thermally sensitive recording medium is prepared by the same procedure to Example 1. As the color developer, 4,4'-isopropyridenediphenol (a) and 4-hydroxy-4'-isopropoxydiphenylsulfone (b) are used. The mixing proportion of dispersion is mentioned below, and the coating is prepared.

| | |
|---|---|
| A solution (dispersion of color developer [a]) | 18.0 parts |
| A solution (dispersion of color developer [b]) | 18.0 parts |
| B solution (dispersion of red color developing leuco dye [R-1]) | 10.58 parts |
| C solution | 3.22 parts |

-continued

| | |
|---|---|
| (dispersion of black color developing leuco dye [B-1]) | |
| Kaoline clay (50% dispersion) | 12.0 parts |

Examples 8~10

The thermally sensitive recording media are prepared by the same procedure to Example 2. At the preparation of B solution, 3,3-bis(1-ethyl-2-methylindole-3-yl)phthalide (shortened to R-2; Example 8), 3-diethylamino-6-methyl-7-chlorofluoran (shortened to R-3; Example 9) and 3-diethylamino-benzo[a]fluoran (shortened to R-4; Example 10) are used instead of 3,3-bis(1-n-butyl-2-methylindol-3-yl)phthalide (R-1).

Example 11

The thermally sensitive recording medium is prepared by the same procedure to Example 2. As the red color developing leuco dye, 3,3-bis(1-n-butyl-2-methylindol-3-yl)phthalide (R-1) and 3,3-bis(1-ethyl-2-methylindole-3-yl)phthalide (R-2) are used. The mixing proportion of dispersion is mentioned below, and the coating is prepared.

| | |
|---|---|
| A solution (dispersion of color developer [a]) | 36.0 parts |
| B solution (dispersion of red color developing leuco dye [R-1]) | 5.29 parts |
| B solution (dispersion of red color developing leuco dye [R-2]) | 5.29 parts |
| C solution (dispersion of black color developing leuco dye [B-1]) | 3.22 parts |
| Kaoline clay (50% dispersion) | 12.0 parts |

Examples 12~17

The thermally sensitive recording media are prepared by the same procedure to Example 2. At the preparation of C solution, 3-(N-ethyl-N-isoamylamino)-6-methyl-7-anilinofluoran (shortened to B-2; Example 12), 3-diethylamino-6-methyl-7-anilinofluoran (shortened to B-3; Example 13)

3-diethylamino-7-(m-trifluoromethylanilino)fluoran (shortened to B-4; Example 14), 3-diethylamino-6-methyl-7-m-methylanilinofluoran (shortened to B-5; Example 15), 3-(N-methyl-N-propylamino)-6-methyl-7-anilinofluoran (shortened to B-6; Example 16) and 3-di-n-pentylamino-6-methyl-7-anilinofluoran (shortened to B-7, Example 17) are used instead of 3-dibutylamino-6-methyl-7-anilinofluoran (B-1).

Example 18

The thermally sensitive recording medium is prepared by the same procedure to Example 2. As the black color developing leuco dye, 3-dibutyl-6-methyl-7-anilinofluoran (B-1) and 3-(N-ethyl-N-isoamylamino)-6-methyl-7-anilinofluoran (shortened to B-2) are used. The mixing proportion of dispersion is mentioned below, and the coating is prepared.

| | |
|---|---|
| A solution (dispersion of color developer [a]) | 36.0 parts |
| B solution (dispersion of red color developing leuco dye [R-1]) | 10.58 parts |
| C solution (dispersion of black color developing leuco dye [B-1]) | 1.61 parts |
| C solution (dispersion of black color developing leuco dye [B-2]) | 1.61 parts |
| Kaoline clay (50% dispersion) | 12.0 parts |

Example 19

The thermally sensitive recording medium is prepared by the same procedure to Example 12. The mixing proportion of dispersion is mentioned below, and the coating is prepared.

| | |
|---|---|
| A solution (dispersion of color developer [a]) | 36.0 parts |
| B solution (dispersion of red color developing leuco dye [R-1]) | 12.88 parts |
| C solution (dispersion of black color developing leuco dye [B-2]) | 0.92 parts |
| Kaoline clay (50% dispersion) | 12.0 parts |

Example 20

The thermally sensitive recording medium is prepared by the same procedure to Example 12. The each dispersion are mixed, stirred and the coating is prepared.

| | |
|---|---|
| A solution (dispersion of color developer [a]) | 36.0 parts |
| B solution (dispersion of red color developing leuco dye [R-1]) | 9.2 parts |
| C solution (dispersion of black color developing leuco dye [B-2]) | 4.6 parts |
| Kaoline clay (50% dispersion) | 12.0 parts |

Example 21

The thermally sensitive recording medium is prepared by the same procedure to Example 12. The each dispersion are mixed, stirred and the coating is prepared.

| | |
|---|---|
| A solution (dispersion of color developer [a]) | 36.0 parts |
| B solution (dispersion of red color developing leuco dye [R-1]) | 13.34 parts |
| C solution (dispersion of black color developing leuco dye [B-2]) | 0.46 parts |
| Kaoline clay (50% dispersion) | 12.0 parts |

Example 22

The thermally sensitive recording medium is prepared by the same procedure to Example 12. The each dispersion are mixed, stirred and the coating is prepared.

| | |
|---|---|
| A solution (dispersion of color developer [a]) | 36.0 parts |
| B solution (dispersion of red color developing leuco dye [R-1]) | 5.06 parts |
| C solution (dispersion of black color developing leuco dye [B-2]) | 8.74 parts |
| Kaoline clay (50% dispersion) | 12.0 parts |

Comparative Example 1

The thermally sensitive recording medium is prepared by the same procedure to Example 1. At the preparation of coating, the dispersion of 3-cyclohexylamino-6-chlorofluoran (shortened to Or) which is orange color developing leuco dye whose maximum absorption wave length is 475 nm is added instead of 3,3-bis(1-n-butyl-2-methylindol-3-yl)phthalide (R-1). The dispersion of Or (D solution) is ground in a wet condition to average diameter of 1 $\mu$m by means of a sand grinder.

| D solution (dispersion of orange color developing leuco dye) | |
|---|---|
| 3-cyclohexylamino-6-chlorofluoran (Or) | 1.0 parts |
| 10% aqueous solution of polyvinylalcohol | 2.3 parts |
| water | 1.3 parts |

Then the resulting dispersion are mixed together by the proportion below and the coating is prepared.

| | |
|---|---|
| A solution (dispersion of color developer [a]) | 36.0 parts |
| D solution (dispersion of orange color developing leuco dye [Or]) | 10.58 parts |
| C solution (dispersion of black color developing leuco dye [B-2]) | 3.22 parts |
| Kaoline clay (50% dispersion) | 12.0 parts |

Method for Estimation

Using a thermally sensitive printer TH-PMD) (product of Ohkura Electric Co., Ltd. Thermally recording paper printing tester which installs Kyosera Thermal head) recording tests are carried out on prepared spontaneously color changing type thermally sensitive recording medium by 0.41 mj/dot impressive energy. The color difference a* and b* value prescript in JIS-Z-8729 is measured by color difference meter (NF999; product of Nihon Denshoku Kogyo Co., Ltd.). C standard light regulated by JIS-Z-8720-1983 is used and measured by angle 2 degree. Further, the color tone of developed image is evaluated by the naked eyes of the inspector. The density of developed color is measured by Macbeth densito meter (RD-914, cyan filter is used) and the measured data is used as the density of untreated specimen. The color developed specimen sheet of thermally sensitive recording medium is stuck on a paper tube on which surface a single layer of wrapping sheet of vinyl chloride is wound, further triple layers of said wrapping sheet are wound on the specimen sheet. After left for 4 hours at room temperature, Macbeth density of the color image part is measured, and the resistance to a plasticizer is evaluated. The obtained results are summarized in Tables 1 and 2.

(Remarks) In Table 1, numerical value in parenthesis shows the blending proportion of a black color developing dye to a red color developing dye, and only in a case of Comparative Example 1, it shows the blending proportion of a black color developing dye to an orange color developing dye. Further, in Table 2, the color tone is that of evaluation by the naked eyes of the inspector.

TABLE 1

| | Kinds of color developer and dye | | |
|---|---|---|---|
| | color | color developing dye | |
| experiment No. | developer | red | black |
| Example 1 | a | R-1 | B-1 (0.3) |
| Example 2 | b | R-1 | B-1 (0.3) |
| Example 3 | c | R-1 | B-1 (0.3) |
| Example 4 | d | R-1 | B-1 (0.3) |
| Example 5 | e | R-1 | B-1 (0.3) |
| Example 6 | f | R-1 | B-1 (0.3) |
| Example 7 | a/b | R-1 | B-1 (0.3) |
| Example 8 | b | R-2 | B-1 (0.3) |
| Example 9 | b | R-3 | B-1 (0.3) |
| Example 10 | b | R-4 | B-1 (0.3) |
| Example 11 | b | R-1/R-2 | B-1 (0.3) |
| Example 12 | b | R-1 | B-2 (0.3) |
| Example 13 | b | R-1 | B-3 (0.3) |
| Example 14 | b | R-1 | B-4 (0.3) |
| Example 15 | b | R-1 | B-5 (0.3) |
| Example 16 | b | R-1 | B-6 (0.3) |
| Example 17 | b | R-1 | B-7 (0.3) |
| Example 18 | b | R-1 | B-1/B-2 (0.3) |
| Example 19 | b | R-1 | B-2 (0.07) |
| Example 20 | b | R-1 | B-2 (0.5) |
| Example 21 | b | R-1 | B-2 (0.03) |
| Example 22 | b | R-1 | B-2 (1.73) |
| Comp. Example 1 | b | Or | B-2 (0.3) |

TABLE 2

| | a*, b*, tone and density after printed | | | | |
|---|---|---|---|---|---|
| experiment No. | a* | b* | color tone | un-treated | resistance to plasticizer |
| Example 1 | 26.4 | −3.8 | wine red | 1.38 | 0.41 |
| Example 2 | 30.8 | −3.1 | wine red | 1.40 | 0.75 |
| Example 3 | 35.7 | −4.9 | wine red | 1.35 | 0.39 |
| Example 4 | 32.2 | −2.2 | wine red | 1.34 | 0.40 |
| Example 5 | 29.4 | −2.8 | wine red | 1.36 | 0.39 |
| Example 6 | 31.3 | −3.3 | wine red | 1.39 | 0.7 |
| Example 7 | 33.3 | −3.6 | wine red | 1.40 | 0.60 |
| Example 8 | 30.7 | −2.9 | wine red | 1.40 | 0.74 |
| Example 9 | 23.7 | 0.9 | wine red | 1.36 | 0.10 |
| Example 10 | 23.2 | 0.4 | wine red | 1.37 | 0.11 |
| Example 11 | 31.0 | −2.9 | wine red | 1.41 | 0.76 |
| Example 12 | 29.0 | −3.3 | wine red | 1.47 | 0.77 |
| Example 13 | 30.0 | −4.7 | wine red | 1.42 | 0.80 |
| Example 14 | 27.5 | −3.7 | wine red | 1.41 | 0.65 |
| Example 15 | 21.0 | 0.6 | wine red | 1.43 | 0.78 |
| Example 16 | 27.9 | −1.4 | wine red | 1.40 | 0.64 |
| Example 17 | 28.5 | −1.3 | wine red | 1.39 | 0.62 |
| Example 18 | 31.3 | −1.5 | wine red | 1.44 | 0.78 |
| Example 19 | 40.3 | −6.3 | bright wine red | 1.41 | 0.80 |
| Example 20 | 18.8 | −2.0 | russet | 1.46 | 0.65 |
| Example 21 | 42.8 | −7.4 | bright wine red | 1.30 | 0.82 |
| Example 22 | 9.7 | −1.7 | bright wine red | 1.37 | 0.56 |
| Comp. Example 1 | 15.3 | 16.2 | light brown | 1.31 | 0.11 |

Evaluation Result

Examples 1~22 of this invention, are the examples which use red color developing leuco dye whose maximum absorption wave length is 480~570 nm and black color developing leuco dye whose absorption maximum wave length is 420~480 nm and 550~640 nm. The color difference a* value of thermally sensitive recording medium of these Examples are within the region of 0~50, and that of color difference b* value are within the region of −15~10, and the color tone of these Examples are russet color or wine red. On the contrary, color difference a* value and b* value of Comparative Example 1 are out of the region regulated by this invention and the aimed color can not, be obtained. And, the Examples 1~8, 11~22 in which the dye represented by general formula (1) is used have a better resistance to a plasticizer than the Examples 9 and 10 in which said dye is not used.

Effect of the Invention

The thermally sensitive recording medium of this invention, has a sufficient color developing density and develops russet color or wine red color, therefore it is suited to be used in a field where these color tone are desired.

What is claimed is:

1. A thermally sensitive recording medium having a thermally sensitive color developing layer comprising a colorless or pale colored dye precursor and a color developer as main components, on a substrate, wherein the color difference a* value, measured according to JIS-Z-8729, of developed image of said thermally sensitive recording medium is 0 to 50, and the color difference b* value measured according to JIS-Z-8729, of developed image of said thermally sensitive recording medium is −15 to 10 wherein the dye precursor comprises at least one red color developing leuco dye whose maximum absorption wave length is 480 to 570 nm and at least one black color developing leuco dye whose maximum absorption wave length is 420 to 480 nm and 550 to 640 nm.

2. The thermally sensitive recording medium of claim 1, wherein the content of black color developing leuco dye whose maximum absorption wave length is 420 to 480 nm and 550 to 640 nm is 0.05 to 1 parts to 1 part of red color developing leuco dye whose maximum absorption wave length is 480 to 570 nm.

3. The thermally sensitive recording medium of claim 1 or claim 2, wherein the red color developing leuco dye whose maximum absorption wave length is 480 to 570 nm contains at least one compound represented by general formula (1), (1)

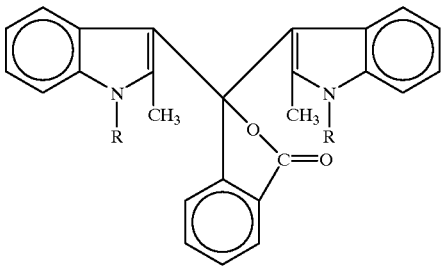

wherein R represents unsubstituted or substituted lower alkyl group whose carbon number is 1 to 8.

4. A colorless or pale colored dye precursor composition which develops russet color or wine red color image upon imagewise exposure to heat in the presence of a color developer comprising at least one red color developing leuco dye whose maximum absorption wave length is 480 to 570 nm and at least one black color developing leuco dye whose maximum absorption wave length is 420 to 480 nm and 550 to 640 nm.

* * * * *